US011674316B2

(12) United States Patent
Osmanski et al.

(10) Patent No.: US 11,674,316 B2
(45) Date of Patent: Jun. 13, 2023

(54) FACADE SUPPORT SYSTEM

(71) Applicant: Hohmann & Barnard, Inc., Hauppauge, NY (US)

(72) Inventors: Richard Osmanski, Hauppauge, NY (US); Christopher Mason, Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 0 days.

(21) Appl. No.: 17/162,540

(22) Filed: Jan. 29, 2021

(65) Prior Publication Data

US 2022/0243480 A1 Aug. 4, 2022

(51) Int. Cl.

| | |
|---|---|
| ***E04B 2/00*** | (2006.01) |
| ***E04F 13/08*** | (2006.01) |
| ***E04B 1/41*** | (2006.01) |
| ***E04F 13/14*** | (2006.01) |
| *E04B 1/38* | (2006.01) |
| *E04B 2/56* | (2006.01) |

(52) U.S. Cl.

CPC ..... *E04F 13/0857* (2013.01); *E04B 1/4107* (2013.01); *E04F 13/14* (2013.01); *E04B 2001/405* (2013.01); *E04B 2002/565* (2013.01)

(58) Field of Classification Search

CPC .... E04F 13/0857; E04F 13/14; E04B 1/4107; E04B 2001/405; E04B 2002/565

USPC ..... 52/506.06

See application file for complete search history.

(56) References Cited

U.S. PATENT DOCUMENTS

| | | | |
|---|---|---|---|
| 779,268 | A | 1/1905 | Elliott |
| 1,697,003 | A | 1/1929 | Fink |
| 2,073,795 | A | 12/1936 | Haugaard |
| 2,363,156 | A | 11/1944 | Sinner et al. |
| 3,050,160 | A | 8/1962 | Chesser |
| 3,234,702 | A | 2/1966 | Zibell |
| 3,414,224 | A | 12/1968 | Robilliard et al. |
| 3,450,427 | A | 6/1969 | Fischer |

(Continued)

FOREIGN PATENT DOCUMENTS

| | | | |
|---|---|---|---|
| BE | 1003846 | A3 | 6/1992 |
| CA | 1 155 329 | A | 10/1983 |

(Continued)

OTHER PUBLICATIONS

IG Steel Lintels Masonry Support & Windpost Systems, Wayback Machine, Aug. 18, 2013, pp. 1-36.

(Continued)

*Primary Examiner* — Basil S Katcheves

(74) *Attorney, Agent, or Firm* — Levenfeld Pearlstein, LLC

(57) ABSTRACT

A facade support system for supporting a veneer on a structure includes a bracket configured to be attached to the structure. The bracket includes a back panel having opposite front and rear faces and a connecting member extending from the back panel in a generally forward direction. The connecting member defines a recess adjacent a front end of the connecting member. The bracket includes a support attachment member at least partially disposed within the recess. The facade support system includes a veneer support constructed to be attached to the bracket by the support attachment member. The veneer support is constructed to be disposed in a mortar bed joint of the veneer.

17 Claims, 8 Drawing Sheets

(56) References Cited

U.S. PATENT DOCUMENTS

| | | | | |
|---|---|---|---|---|
| 3,680,271 | A | 8/1972 | Satchell | |
| 3,942,292 | A | 3/1976 | Robinson | |
| 4,013,253 | A | 3/1977 | Perrault et al. | |
| 4,390,103 | A | 6/1983 | Husband | |
| 4,515,494 | A | 5/1985 | Robilliard et al. | |
| 4,805,364 | A | 2/1989 | Smolik | |
| 4,827,684 | A | 5/1989 | Allan | |
| 4,869,043 | A | 9/1989 | Hatzinikolas et al. | |
| 5,035,099 | A | 7/1991 | Lapish | |
| 5,063,715 | A | 11/1991 | Goodman | |
| 5,082,388 | A | 1/1992 | Lauterbach | |
| 5,236,625 | A | 8/1993 | Bardo et al. | |
| 5,265,396 | A | 11/1993 | Amimoto | |
| 5,313,752 | A | 5/1994 | Hatzinikolas | |
| 5,392,581 | A | 2/1995 | Hatzinikolas et al. | |
| 5,619,834 | A * | 4/1997 | Chen | E04F 13/0855 52/126.1 |
| 5,816,008 | A | 10/1998 | Hohmann | |
| 6,128,883 | A * | 10/2000 | Hatzinikolas | E04B 1/4178 52/378 |
| 6,161,709 | A | 12/2000 | Kluge et al. | |
| 6,298,620 | B1 | 10/2001 | Hatzinikolas | |
| 6,584,741 | B1 | 7/2003 | Hatzinikolas | |
| 6,973,756 | B2 | 12/2005 | Hatzinikolas | |
| D550,540 | S | 9/2007 | Nawrocki | |
| 7,367,165 | B2 | 5/2008 | Hatzinikolas | |
| 7,392,911 | B2 | 7/2008 | Stitchick et al. | |
| 7,415,803 | B2 | 8/2008 | Bronner | |
| 7,469,659 | B2 | 12/2008 | de Jonge et al. | |
| 7,614,590 | B2 * | 11/2009 | Boville | F16B 7/22 248/72 |
| 7,654,058 | B2 | 2/2010 | Hatzinikolas | |
| 7,908,804 | B2 | 3/2011 | Vieira | |
| 8,051,621 | B2 | 11/2011 | Hatzinikolas | |
| 8,333,048 | B2 | 12/2012 | Talpe | |
| 8,490,340 | B2 | 7/2013 | Hatzinikolas | |
| 8,490,341 | B2 | 7/2013 | Hatzinikolas | |
| 8,516,763 | B2 | 8/2013 | Hohmann, Jr. | |
| 8,555,595 | B2 | 10/2013 | Hatzinikolas | |
| 8,621,802 | B2 | 1/2014 | Spyrou | |
| 8,667,763 | B2 | 3/2014 | Hatzinikolas | |
| 8,893,452 | B2 | 11/2014 | Hatzinikolas | |
| 8,955,263 | B2 | 2/2015 | Hatzinikolas | |
| 9,010,050 | B2 | 4/2015 | Hatzinikolas | |
| 9,010,062 | B2 | 4/2015 | Hill | |
| 9,027,301 | B2 | 5/2015 | Guinn | |
| 9,234,344 | B2 | 1/2016 | Hatzinikolas | |
| 9,316,004 | B1 * | 4/2016 | Hatzinikolas | E04F 13/14 |
| 9,447,585 | B2 * | 9/2016 | Hatzinikolas | E04F 13/142 |
| 10,294,676 | B2 | 5/2019 | Hatzinikolas | |
| 10,323,419 | B2 * | 6/2019 | Hatzinikolas | E04F 13/0801 |
| 2004/0221535 | A1 | 11/2004 | Hatzinikolas | |
| 2005/0246987 | A1 | 11/2005 | Hatzinikolas | |
| 2006/0053743 | A1 | 3/2006 | Hatzinikolas | |
| 2006/0272251 | A1 | 12/2006 | Hatzinikolas | |
| 2008/0098681 | A1 | 5/2008 | Hatzinikolas | |
| 2010/0088992 | A1 | 4/2010 | Hatzinikolas | |
| 2010/0287864 | A1 | 11/2010 | Hatzinikolas | |
| 2010/0287865 | A1 | 11/2010 | Hatzinikolas | |
| 2011/0061337 | A1 * | 3/2011 | O'Shea | E04F 13/0808 52/747.12 |
| 2012/0005981 | A1 | 1/2012 | Hatzinikolas | |
| 2012/0125646 | A1 | 5/2012 | Hatzinikolas | |
| 2012/0192504 | A1 | 8/2012 | Hatzinikolas | |
| 2012/0279143 | A1 | 11/2012 | Hatzinikolas | |
| 2014/0150373 | A1 | 6/2014 | Hatzinikolas | |
| 2014/0174014 | A1 | 6/2014 | Hatzinikolas | |
| 2014/0190110 | A1 | 7/2014 | Hatzinikolas | |
| 2015/0059259 | A1 | 3/2015 | Hatzinikolas | |
| 2016/0201314 | A1 | 7/2016 | Hatzinikolas | |
| 2016/0305113 | A1 * | 10/2016 | Hatzinikolas | E04F 13/0801 |
| 2017/0284104 | A1 | 10/2017 | Hatzinikolas | |
| 2019/0024381 | A1 | 1/2019 | Hatzinikolas | |
| 2020/0190814 | A1 * | 6/2020 | Hatzinikolas | E04F 13/09 |
| 2021/0310252 | A1 * | 10/2021 | Hatzinikolas | E04F 13/0862 |

FOREIGN PATENT DOCUMENTS

| | | | |
|---|---|---|---|
| CA | 1 251 336 | A | 3/1989 |
| CA | 1 294 457 | C | 1/1992 |
| CA | 2 034 085 | C | 2/1995 |
| CA | 2 254 510 | A1 | 5/2000 |
| CA | 2 284 069 | C | 5/2000 |
| CA | 2 591 687 | A1 | 5/2000 |
| CA | 2 759 747 | A1 | 5/2000 |
| CA | 2 759 778 | A1 | 5/2000 |
| CA | 2 759 837 | A1 | 5/2000 |
| CA | 2 102 297 | C | 1/2001 |
| CA | 2 249 509 | C | 6/2005 |
| CA | 2 700 636 | C | 10/2012 |
| CA | 2 518 030 | C | 6/2013 |
| CA | 2 769 821 | A1 | 8/2013 |
| CA | 2 865 824 | A1 | 9/2013 |
| CA | 2 738 488 | C | 4/2015 |
| CA | 2 804 542 | C | 5/2015 |
| CA | 2 872 778 | A1 | 6/2016 |
| CA | 2 872 780 | A1 | 6/2016 |
| CA | 2 888 404 | A1 | 10/2016 |
| DE | 77 14 716 | U1 | 9/1977 |
| DE | 32 39 161 | A1 | 5/1983 |
| DE | 39 1 0 286 | A1 | 10/1990 |
| DE | 44 41 051 | A1 | 5/1996 |
| DE | 101 17199 | A1 | 10/2002 |
| EP | 0 566 829 | A1 | 10/1993 |
| EP | 0 869 232 | A1 | 10/1998 |
| EP | 1 211 364 | A2 | 6/2002 |
| EP | 1 353 021 | B1 | 10/2003 |
| EP | 1 375 777 | A1 | 1/2004 |
| EP | 2 397 622 | A1 | 12/2011 |
| FR | 2 738 025 | A1 | 2/1997 |
| GB | 2 263 918 | A | 8/1993 |
| GB | 2 288 831 | A | 11/1995 |
| GB | 2 375 552 | A | 11/2002 |
| GB | 2 505 980 | A | 3/2014 |
| IE | 2013/0144 | A1 | 11/2013 |
| WO | 2019014740 | A1 | 1/2019 |

OTHER PUBLICATIONS

Fero Fast Angle Support Technology, Wayback Machine, Mar. 17, 2012, pp. 1-4.

Bespoke Bracket Angle Support, Ancon Ltd., pp. 1-6, Aug. 21, 2018.

Non-Welded Bracket Angle Support, Ancon Ltd., pp. 1-5, Aug. 21, 2018.

Mortar Collection Systems, HB Mortar Trap[TM] with CMU Detail, 1 page, at least as early as Jan. 29, 2021.

* cited by examiner

FACADE SUPPORT SYSTEM

FIELD

The present invention generally relates to a facade support system used in building construction, and more specifically, to a hanger type facade support system.

BACKGROUND

A facade can be a durable and aesthetically desirable construction for a building exterior. Facades, such as brick or stone veneer walls, also provide protection to the interior of the building from the surrounding environment. Facade supports are typically metal structures attached to inner structure, such as walls, columns, beams, or other frameworks, of the building and provide a support surface for the outer veneer wall and transfer the load of the veneer wall to the inner structure of the building. In some instances, the space available for the façade support and veneer is quite limited.

SUMMARY

In one aspect, a facade support system for supporting a veneer on a structure comprises a bracket configured to be attached to the structure. The bracket includes a back panel having opposite front and rear faces. The bracket also includes a connecting member extending from the back panel in a generally forward direction. The connecting member defines a recess adjacent a front end of the connecting member. The bracket also includes a support attachment member at least partially disposed within the recess. The facade support system also comprises a veneer support configured to be attached to the bracket by the support attachment member. The veneer support is configured to be disposed in a mortar bed joint of the veneer.

In another aspect, a facade support bracket for holding a veneer support having a mounting flange and a support flange, and being constructed to support a veneer on a structure, comprises a back panel having opposite front and rear faces. The bracket also comprises a connecting wall extending from the back panel in a generally forward direction. The connecting wall defines a recess adjacent a front end of the connecting wall. The bracket also comprises a support attachment member at least partially disposed within the recess and configured to attach the veneer support to the façade support bracket within the recess of the connecting wall.

Other objects and features of the present disclosure will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
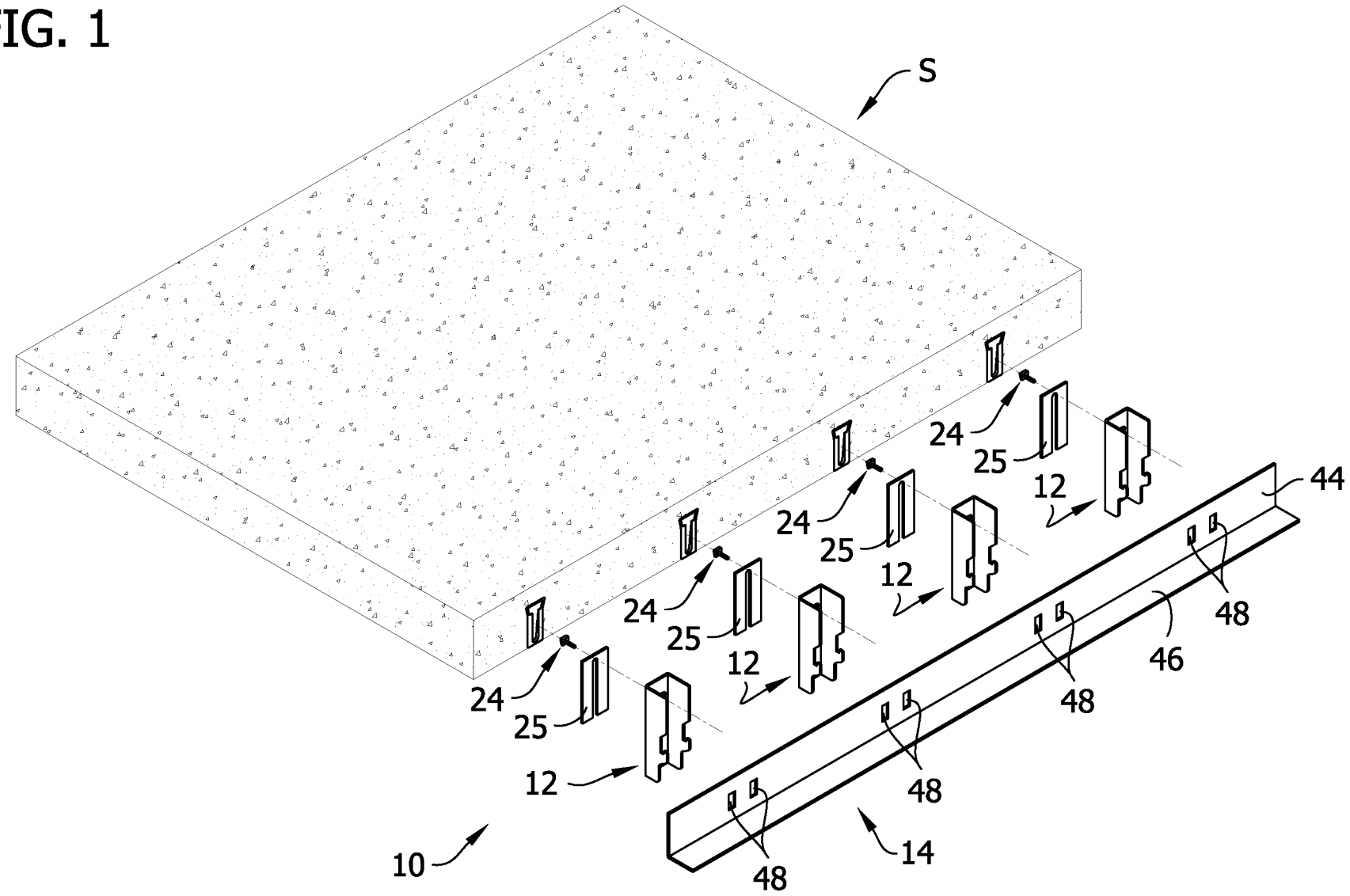
FIG. 1 is a schematic, exploded perspective of a facade support system and portion of a building.
Figure 2:
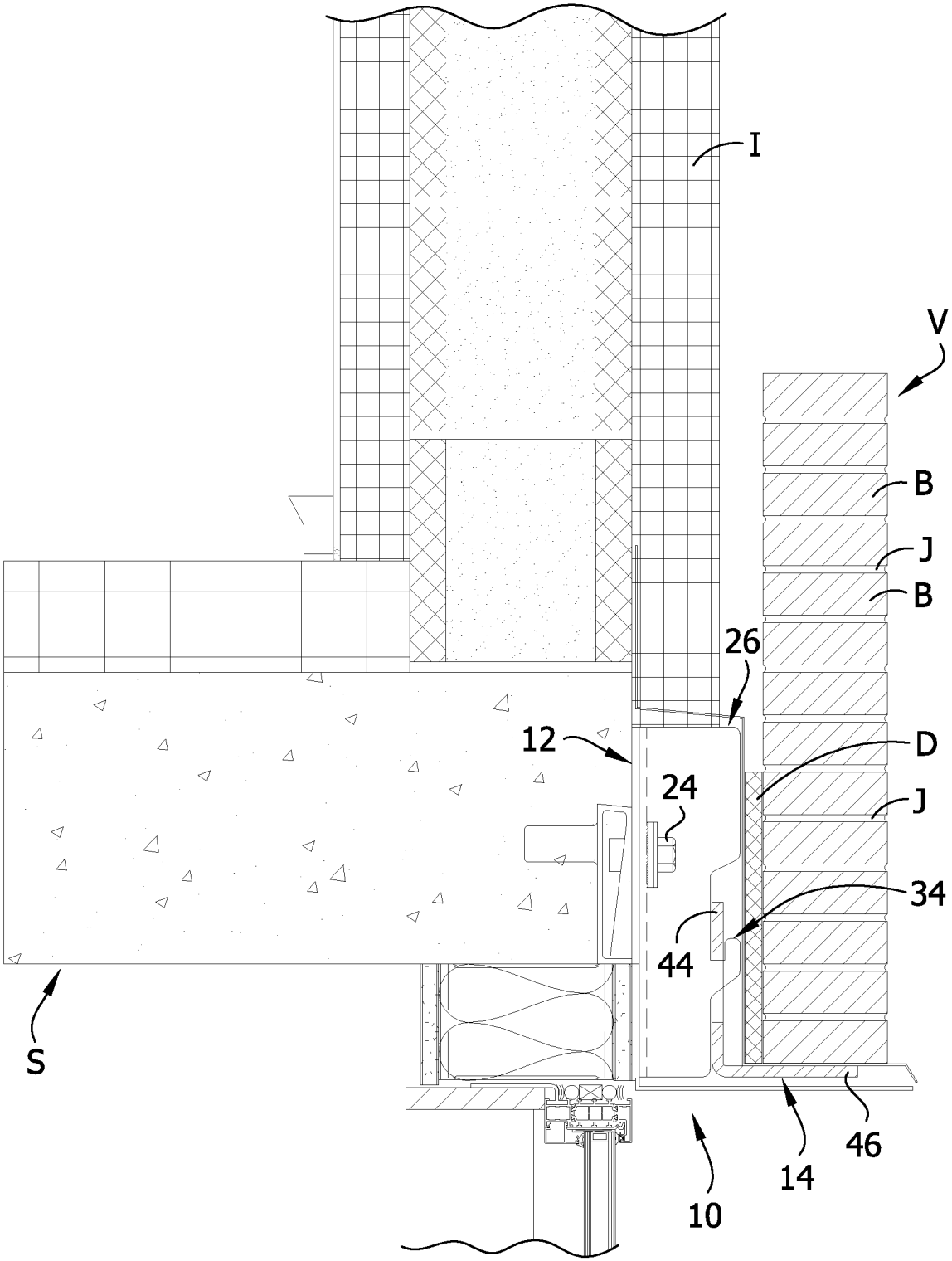
FIG. 2 is a fragmentary, cross-sectional view of the facade support system attached to a structure and supporting a facade.

Referring to FIGS. 1-5, a facade support system according to one embodiment of the present disclosure is generally indicated by reference numeral 10. The facade support system 10 is mounted to an inner structure S of a building or other structure, and supports and connects a veneer V (e.g., veneer wall) to the inner structure. In the illustrated embodiment, the inner structure S is a concrete slab or floor, although the facade support system 10 may be mounted to other inner structures such as walls (e.g., wood/steel framed walls), columns, beams, joists, roof, and/or other structural supporting members. Referring to FIG. 2, the veneer V in the illustrated embodiment is made up of bricks B (broadly, masonry units) to form the building's brick facade. It will be understood that stone or other suitable veneer may be supported using the facade support system 10 of the present disclosure. The veneer V has successive bed joints J filled with mortar formed between courses of the bricks B that are substantially planar and horizontally disposed. The support system 10 transfers the weight of the veneer V (e.g., bricks B) to the inner structure S. Thus, the facade support system 10 supports the weight of the bricks B forming the building facade. The facade support system 10 is configured such that it is concealed within the bricks B when the facade is complete. Insulation I may be disposed around the facade support system 10 between the inner structure S and the veneer V. In one embodiment, a mortar collection device D (e.g., mortar trap) may be disposed between the backside of the veneer V and a portion (the mounting flange 44 of the veneer support 14, described below) of the facade support system 10. As known in the art, the mortar collection device D is configured to break up mortar droppings and/or prohibit mortar from creating a moisture retaining barrier so that water can flow freely into any weep holes in the veneer V.

The facade support system 10 includes spaced apart support brackets 12 (broadly, a bracket or one or more brackets) and a veneer support 14 (broadly, a support) attached to the support brackets for supporting the weight of the veneer V. The support brackets 12 hold the veneer support 14. The support brackets 12 are identical. Accordingly, one support bracket 12 will now be described with the understanding the description applies to all the support brackets.

Figure 3:
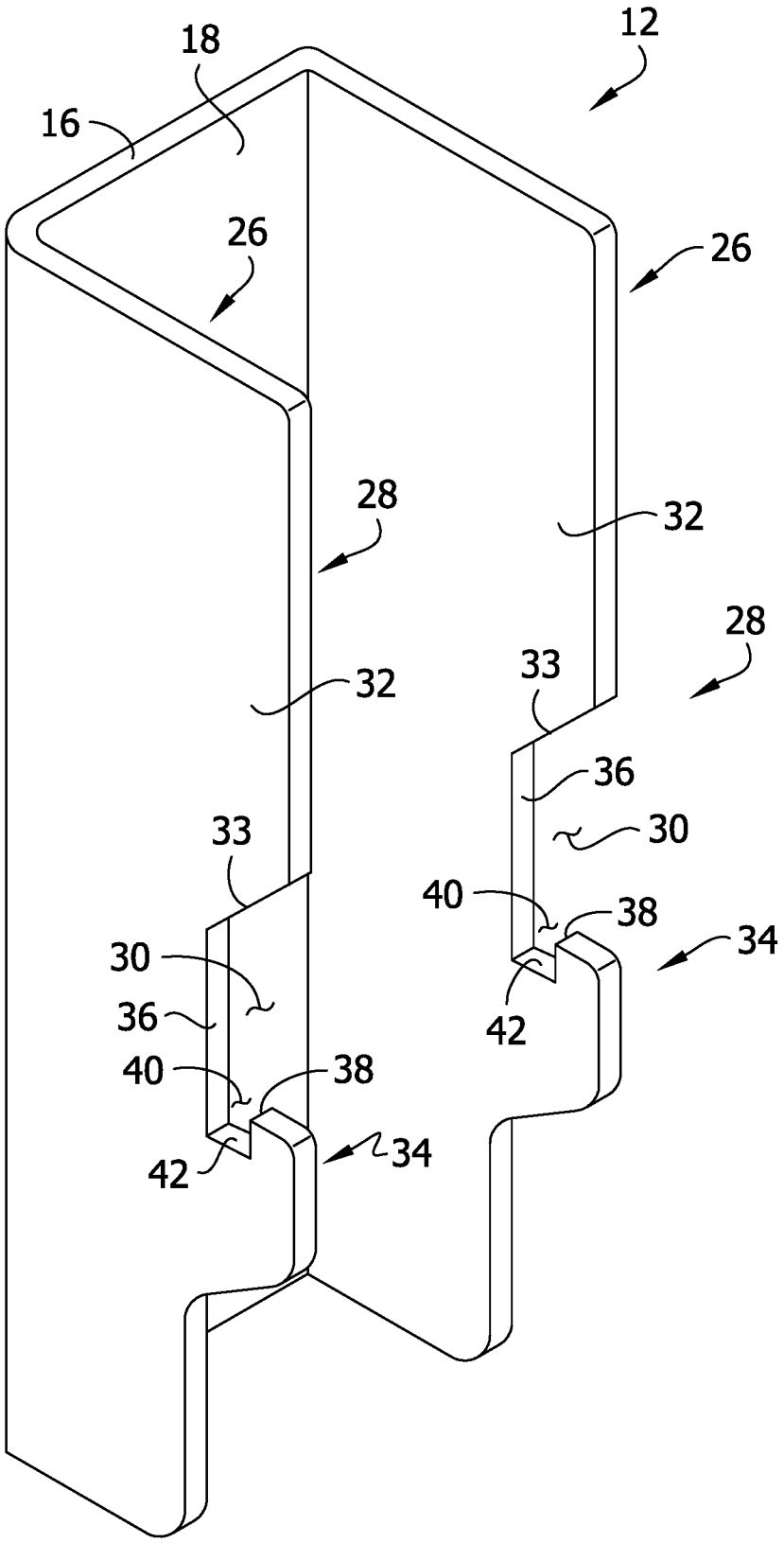
FIG. 3 is a perspective of a bracket of the facade support system.
Figure 4:
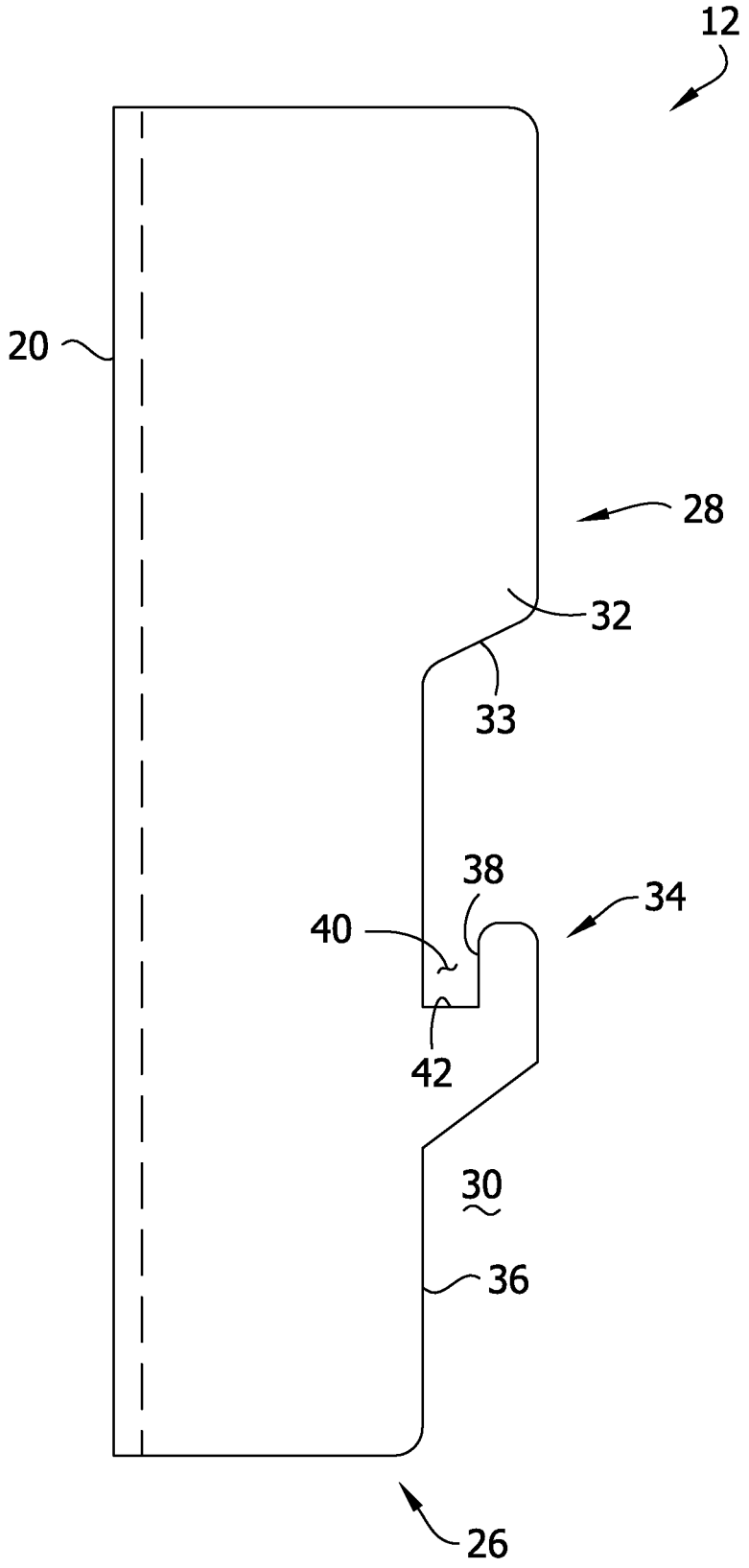
FIG. 4 is a left side view of the bracket, the right side view being a mirror image thereof.
Figure 5:
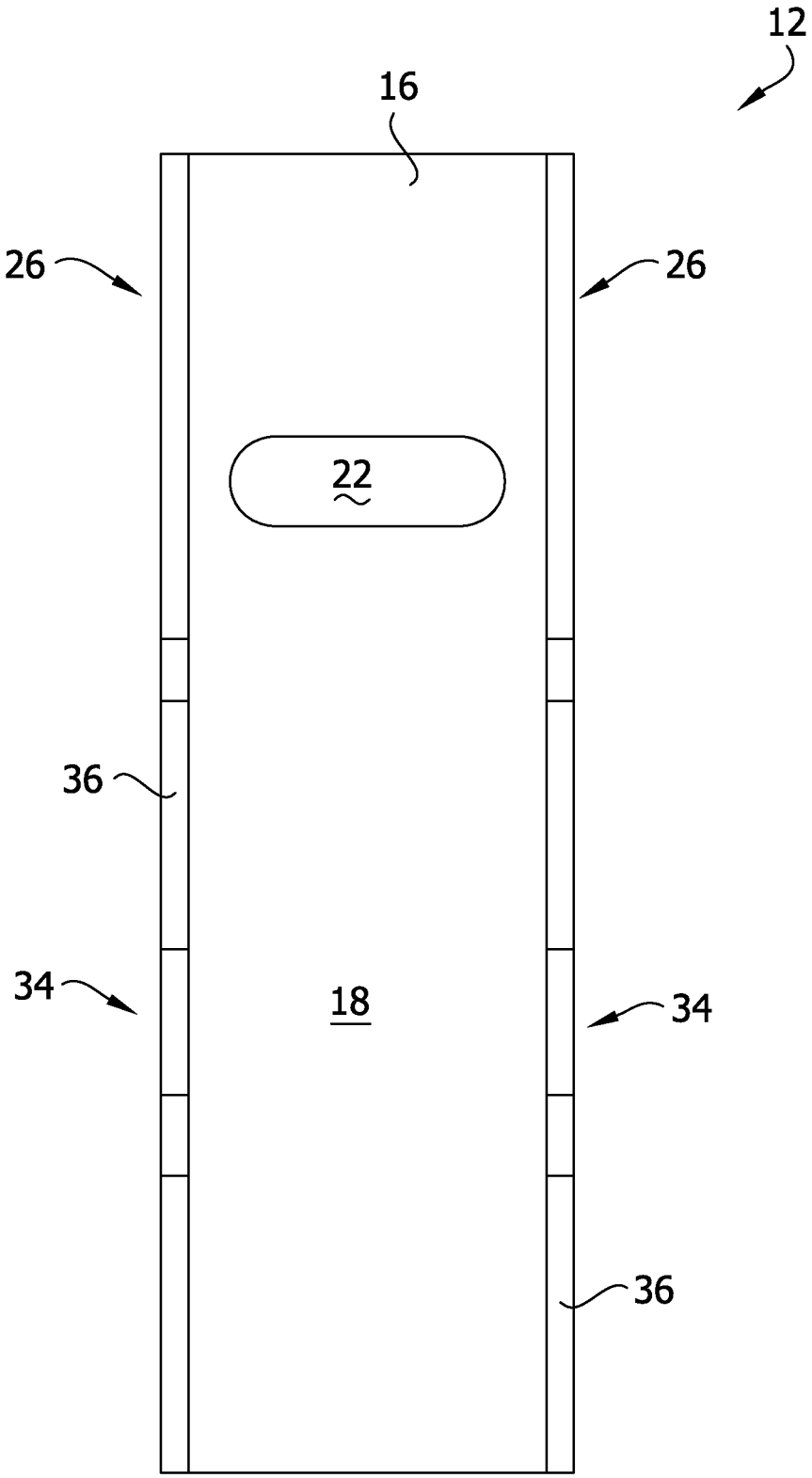
FIG. 5 is a front view of the bracket.

Referring to FIGS. 3-5, the support bracket 12 includes a back panel 16 having opposite front and rear faces or surfaces 18, 20. The bracket 12 is configured to be attached to the inner structure S of the building. The back panel 16 of the bracket 12 includes a fastener slot 22 sized and shaped to receive a fastener 24 (FIG. 2) to connect the bracket to the building. In the illustrated embodiment, the fastener slot 22 is elongate and extends generally horizontally, although other configurations are within the scope of the present disclosure. The fastener slot 22 permits adjustments (e.g., horizontal adjustments of the bracket relative to the inner structure S) in the field. The bracket 12 is configured to extend through the insulation I. The support bracket 12 includes first and second connecting members 26 (broadly, at least one connecting member). Each connecting member 26 extends from the back panel 16 in a generally first or forward direction. Each connecting member 26 is configured to extend through the insulation I. In one embodiment, a notch is cut out of the insulation I to permit the connecting members 26 to extend therethrough. The bracket 12 has a generally C-channel shape. The first connecting member 26 extends from a first side edge margin of the back panel 16 and the second connecting member extends from an opposite, second side edge margin of the back panel. Otherwise, the first and second connecting members 26 are identical. Accordingly, one connecting member 26 will now be described with the understanding the description applies to the other connecting member. In the illustrated embodiment, the connecting member 26 comprises a panel or flange. The connecting member or arm 26 (e.g., connecting wall) has a front end 28 opposite the back panel 16. The front end 28 is a free end. The connecting wall 26 defines a recess 30 adjacent the front end 28 of the connecting wall. The recess 30 has an open front end. In the illustrated embodiment, the recess 30 extends to the bottom of the bracket 12 and has an open bottom end. The connecting wall 26 includes an overhang portion 32 defining at least a portion of the recess 30. In the illustrated embodiment, the overhang portion 32 defines the top end of the recess 30. The overhang portion 32 of the connecting wall 26 includes an edge 33 defining an upper boundary of the recess 30. In the illustrated embodiment, the edge 33 of the connecting wall 26 extends at an angle with respect to the front end 28 of the connecting wall. The angle of the edge 33 enlarges the front end of the recess 30 to provide more clearance, and thereby making it easier, to insert the veneer support 14 into the recess and attach the veneer support to the bracket 12. The recess 30 is sized and shaped to receive at least a portion of the veneer support 14.

The bracket 12 includes first and second support attachment members 34 (broadly, at least one support attachment member) configured to attach the veneer support 14 to the bracket. In the illustrated embodiment, the first and second support attachment members 34 are identical, with each support attachment member being attached to a respective one of the connecting walls 26. Accordingly, one support attachment member 34 (and its relation to one of the connecting walls 26) will now be described with the understanding the description applies to the other support attachment member. The support attachment member 34 is at least partially disposed within the recess 30 of the connecting wall 26. Accordingly, the overhang portion 32 of the connecting wall 30 overlies at least a portion of the support attachment member 26. In the illustrated embodiment, the support attachment member 34 is disposed entirely within the recess 30. In this embodiment, the front end of the support attachment member 34 is generally even with the front end 28 of the connecting wall 30. Accordingly, the overhang portion 32 of the connecting wall 26 overlies the entirety of the support attachment member. Other configurations between the support attachment member 34 and the recess 30 are within the scope of the present disclosure. For example, in some embodiments a portion of the support attachment member 34 may protrude from (in the forward direction), or be recessed from the open front end of the recess 30. In the illustrated embodiment, the support attachment member 34 comprises a hook, although other configurations are within the scope of the present disclosure.

The support attachment member 34 and the connecting wall 26 are configured to form a moment couple with the veneer support 14 to inhibit rotation of the veneer support relative to the bracket 12 when connected to the bracket. The connecting wall 26 includes a support bracing surface 36. The support bracing surface 36 is generally planar in the illustrated embodiment. The support bracing surface lies in a generally vertically extending plane. The support bracing surface 36 is configured to brace the veneer support 14 when the veneer support is attached or connected to the bracket 12. The support bracing surface 36 is disposed rearward of the front end 28 of the connecting wall 26. The support bracing surface 36 defines at least a portion of the recess 30. In the illustrated embodiment, the support bracing surface 36 defines a rear end of the recess 30. As illustrated, the support attachment member 34 generally extends (in a forward direction) from the support bracing surface 36. The support bracing surface 36 is disposed both above and below the support attachment member.

The support attachment member 34 includes a support securing surface 38 spaced apart from and opposing the support bracing surface 36. The support securing surface 38 and the support bracing surface 36 define a receiving space 40 (e.g., a veneer support receiving space) therebetween to receive the veneer support 14 when the veneer support is attached to the bracket 12. As illustrated, the receiving space 40 is within the recess 30. The support securing surface 38 is generally planar. In the illustrated embodiment, the support securing surface 38 lies in a generally vertically extending plane. The support securing surface 38 and the support securing surface are generally parallel to one another. The support securing surface 38 is disposed in front of the support bracing surface 36. The support securing surface 38 may be disposed within the recess 30 or in front of the recess. In some embodiments, the support securing surface 38 may extend at an angle to the support bracing surface 36 (e.g., at an angle to the vertical), such as about 10 degrees. For example, in one embodiment, the support securing surface 38 may extend away from the support bracing surface 36 as the support securing surface extends generally upward. As shown, the support securing surface 38 has a rounded upper edge margin that extends away from the support bracing surface 36.

The support attachment member 34 also includes a seat or base 42 configured to engage and support the veneer support 14 when the veneer support is attached to the bracket 12. The seat 42 is disposed between the support bracing surface 36 and the support securing surface 38. The seat 42 is generally planar and lies in a generally horizontal plane. The seat 42 defines the bottom of the receiving space 40 with the support bracing surface 36 and the support securing surface 38 defining opposite sides (e.g., front and rear ends) of the receiving space. The receiving space 40 has an open top sized and shaped to permit the veneer support 14 to be moved into the receiving space. When the veneer support 14 is attached to the bracket 14, the veneer support (e.g., a portion thereof) is disposed in the receiving space 40 and supported by the seat 42. The support bracing surface 36 and the support securing surface 38 engage (or may engage) the veneer support 14 to form a moment couple and prevent the veneer support from rotating relative to the bracket 12. Preferably, the support bracing surface 36 and the support securing surface 38 engage the veneer support 14 at vertically spaced apart locations. For example, in a typical operation, the support bracing surface 36 will engage and brace the veneer support 14 at a location below the seat 42 and the support securing surface 38 will engage and brace the veneer support at a location above the seat.

By forming a recess 30 in the connecting wall 26 and positioning (at least partially) the support attachment member 34 in the recess, the facade support system 10 is able to locate the veneer support 14 closer to the inner structure S, thereby permitting the facade support system 10 to be used in smaller or tighter spaces than conventional systems and/or to locate the veneer V closer to the inner structure S. The overall depth of the connecting wall 26, including the overhang portion 32 helps maintain the overall strength of the connecting wall and compensates for the loss of strength due to the recess 30. The veneer V imparts a significant moment force on the bracket 12, via the veneer support 14, that the bracket 12 (specifically, the connecting wall 26) needs to resist. Although the recess 30 is formed in the connecting wall 26, away (i.e., above) the recess, the depth (e.g., front to rear dimension) of the connecting wall is maintained thereby allowing the connecting wall 26 to handle the large moment forces imparted by the weight of the veneer V. Reducing the depth of a connecting wall over its entire height would reduce the ability for the connecting wall to resist the moment forces imparted by the veneer V, which can lead to failure of the bracket. The recess 30 also permits the connecting wall 26 to be formed from thinner material (e.g., a higher gauge of sheet metal), than if the overall depth of a connection member (without a recess) was reduced. It is quicker and cheaper to make the bracket 12 out of thinner material, than the thicker material that would be required if the overall depth of a connection portion (without a recess) was reduced in order to resist the moment forces from the veneer V. Thus, the recess 30 maintains the load bear capacity of the bracket 12 while permitting the bracket to be used in smaller spaces.

Referring back to FIGS. 1 and 2, the veneer support 14 is configured to be attached to the bracket 12. Specifically, the veneer support 14 is attached to the two connecting walls 26 of the bracket 12 via the two support attachment members 34 (broadly, the veneer support is configured to be attached to the bracket by one or more of the support attachment members). The veneer support 14 is constructed or configured to support the veneer V of the building or structure. The veneer support 14 includes a mounting flange 44 (e.g., a first, vertical flange or plate member) and a support flange 46 (e.g., a second, horizontal flange or plate member). The support flange 46 extends from a bottom or lower edge margin of the mounting flange 44. The mounting flange 44 includes several slots 48, each configured to receive one of the support attachment members 34 (e.g., hooks) to attach the veneer support 14 to the one or more support brackets 12. In the illustrated embodiment, the slots 48 are arranged in pairs and spaced apart along the length of the veneer support, with each pair of slots configured to attach the veneer support to one of the support brackets 12. Other ways of attaching the veneer support 14 to the support bracket 12 are within the scope of the present disclosure. For example, the veneer support 14 can be attached to the support bracket 12 by welding or with fasteners. The veneer support 14 is configured to be disposed in the mortar bed joint J of the veneer V. Specifically, the support flange 46 is configured to be disposed in a mortar bed joint J between adjacent courses of bricks B. The support flange 46 is thin and flat so as not to significantly alter the height of the mortar bed joint in which it is received. Preferably, the support flange 46 is thin enough to fit within a standard ⅜ inch (1 cm) height mortar bed joint. The support flange 46 is planar and free of projections from its top or bottom surfaces. Thus, the veneer support 14 can be positioned anywhere along the length of the motor bed joint J. In other embodiments, the support flange 46 may not be configured to be disposed in a mortar bed joint J. In this embodiment (or the embodiment where the support flange 46 is configured to be disposed in the mortar bed joint J), the support flange 46 may be used to support the lower-most course of bricks B of the veneer wall V (or of a section of the veneer wall), as shown in FIG. 2.

The one or more support attachment member 34 are configured to attach the veneer support 14 to the support bracket 12 within the recess(es) 30 of the one or more connecting walls 26. As shown in FIG. 2, when the veneer support 14 (e.g., mounting flange 46) is attached to the support bracket 12 by the one or more support attachment members 34, at least a portion of the veneer support is disposed rearward of the front end(s) 28 of the one or more connecting walls 26. In particular, the mounting flange 44 (e.g., the entirety thereof) is disposed rearward of the front end 28 of the connecting wall 26. Accordingly, in the illustrated embodiment, the recess 30 is sized and shaped to receive an entirety of the cross section of the mounting flange 46. The mounting flange 44 is disposed in the recess 30, with the support flange 46 extending forward, out of the recess toward (e.g., to) the veneer V. By being able to position the mounting flange 44 (broadly, a portion of the veneer support 14) rearward of the front end 28 of the connecting wall 26, the overall depth (from the rear face 20 to the front edge of the support flange 46) of the facade support system 10 is reduced, enabling the system to be used in smaller spaces.

In some embodiments, the facade support system 10 may include one or more shims 25 (FIG. 1) configured to be positioned between the inner structure S and the support bracket 12 to offset or selectively space apart the support bracket from the inner structure in order to plum or horizontally align the support brackets attached to the veneer support 14.

Figure 6:
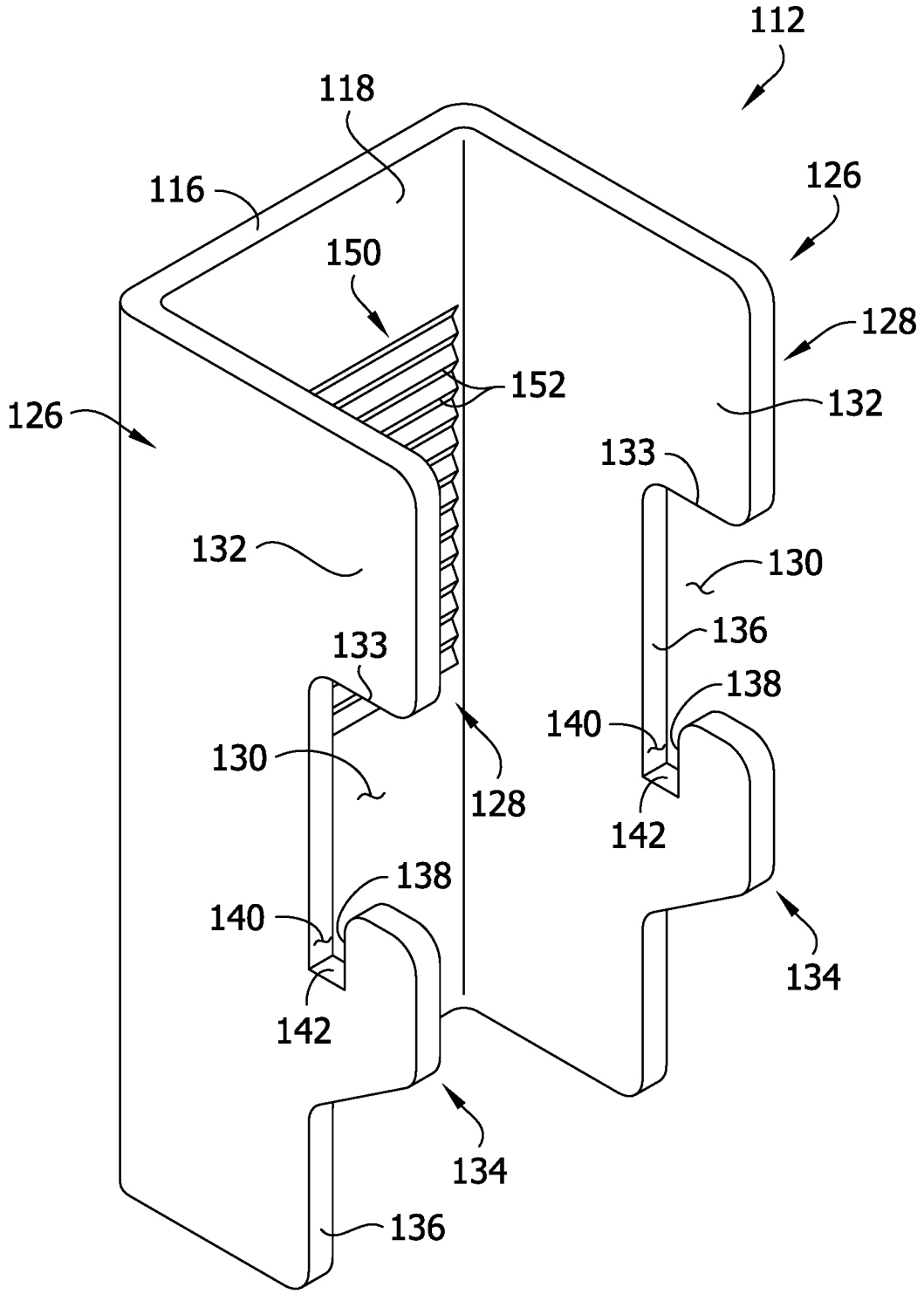
FIG. 6 is perspective of a bracket according to another embodiment of the present disclosure.
Figure 7:
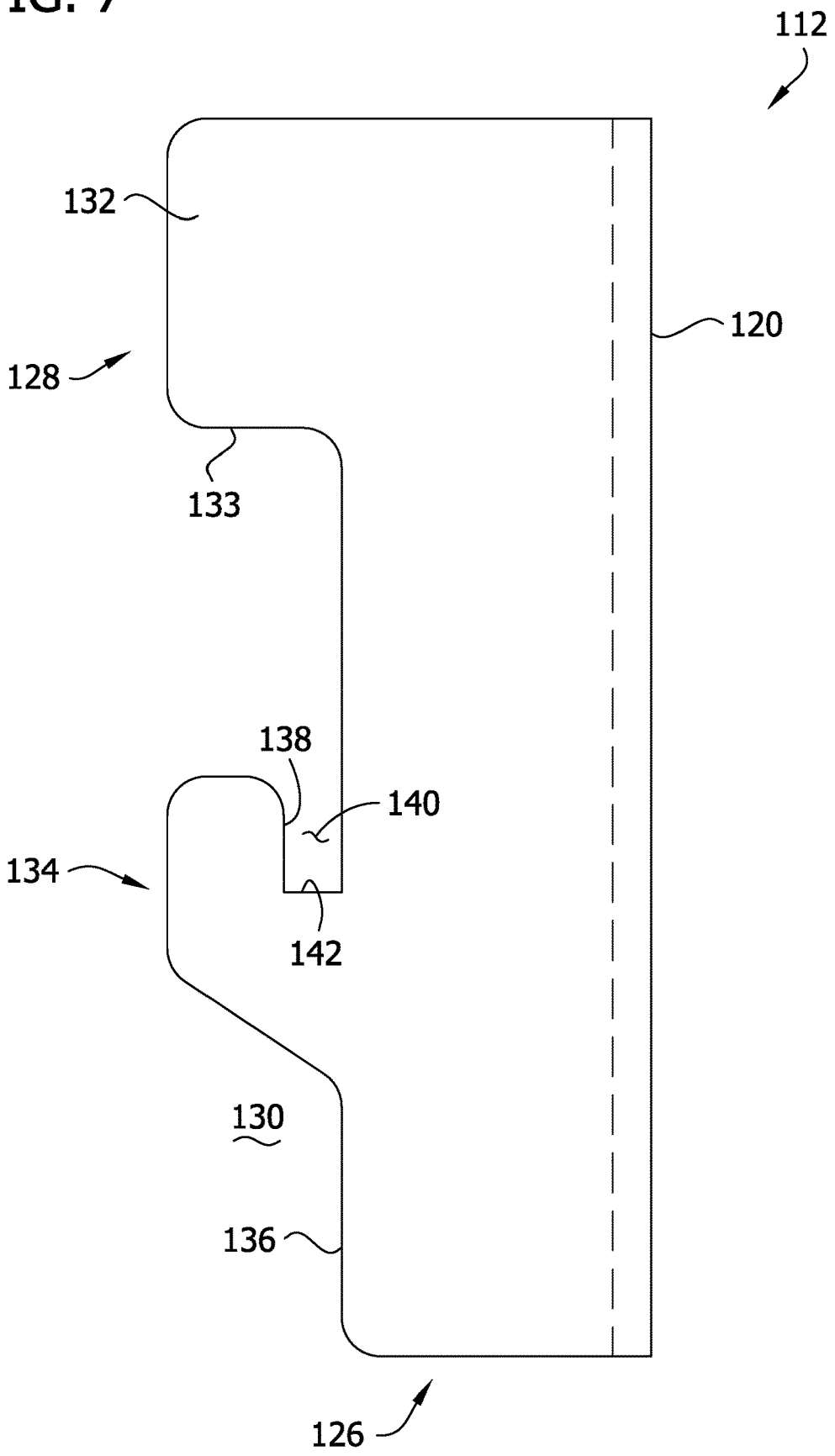
FIG. 7 is a right side view of the bracket of FIG. 6, the left side view being a mirror image thereof.
Figure 8:
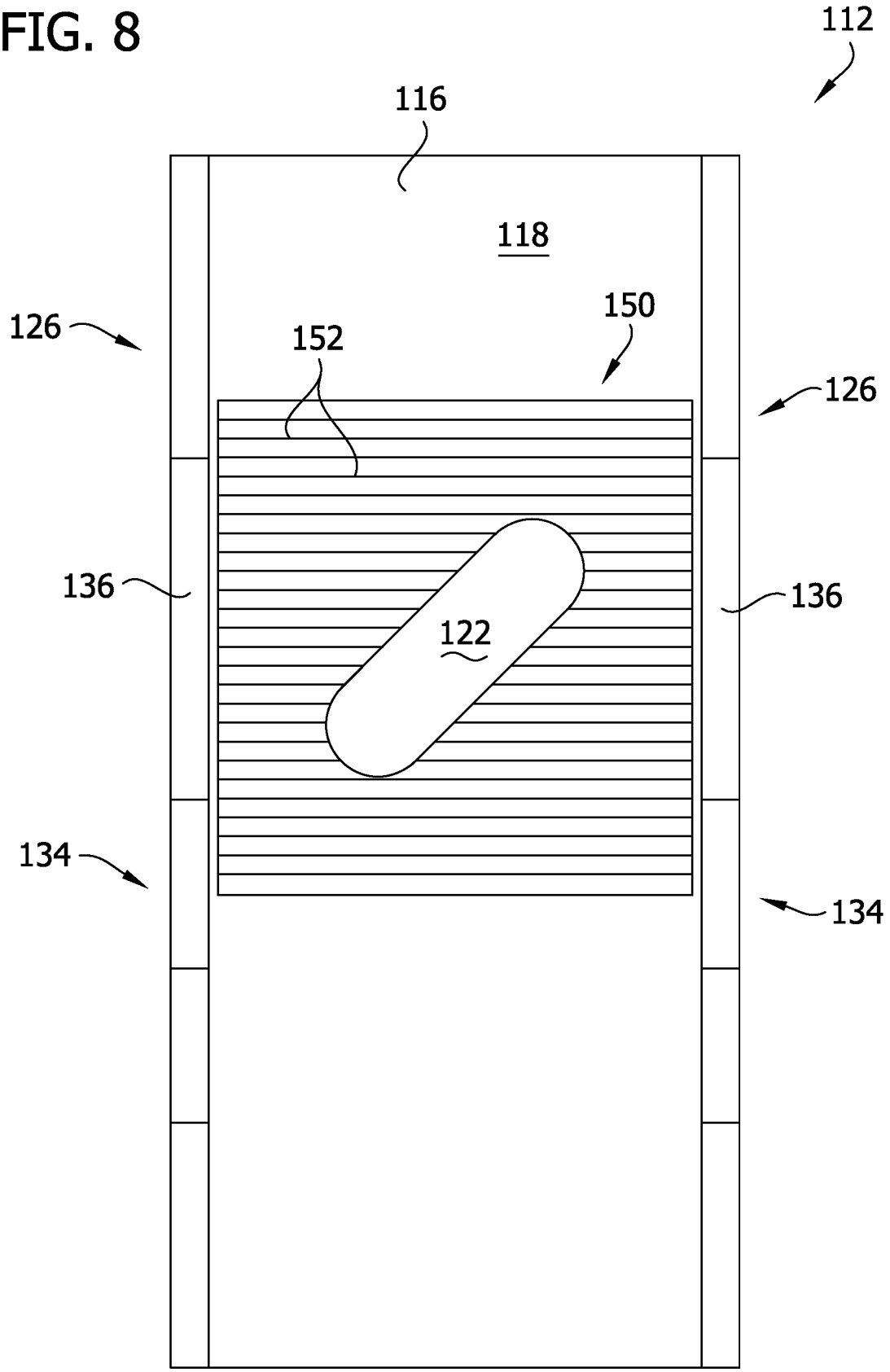
FIG. 8 is a front view of the bracket of FIG. 6.

Referring to FIGS. 6-8, another embodiment of the support bracket of the present disclosure for the facade support system 10 is generally indicated at reference numeral 112. The support bracket 112 can be used with the veneer support 14 as part of the facade support system 10 to support the veneer V. Support bracket 112 is generally similar or analogous to support bracket 12 and, thus, for ease of comprehension, where similar, analogous or identical parts are used, reference numerals "100" units higher are employed. Accordingly, unless stated or indicated otherwise, the above descriptions regarding support bracket 12 also apply to support bracket 112.

In this embodiment, the fastener slot 122 extends at an angle, such as about a 45-degree angle, relative to the horizontal (FIG. 8). This angle of the fastener slot 122 enables both horizontal and vertical adjustments of the bracket 112 relative to the inner structure S in the field. In addition, in this embodiment, the support bracket 112 also includes a serrated portion 150. The serrated portion 150 is made up of a plurality of detents or serrations 152. The serrated portion 150 is disposed on the front surface 118 of the back panel 116. As shown in FIG. 8, the serrated portion 150 surrounds the fastener slot 122. The serrated portion 150 facilitates adjustable connection of the bracket 112 to the fastener 24 securing the bracket to the inner structure S of the building or structure. In this embodiment, a washer (not shown) on the fastener 24 includes a corresponding serrated portion having corresponding detents that engage (e.g., mesh with) the detents 152 of the serrated portion 150 on the bracket 112. The detents of the washer engage the detents 152 (e.g., a portion thereof) of the serrated portion 150 on the bracket 112 to lock the washer and fastener 24 in place in the slot 122 (and relative to the support bracket), thus preventing any relative movement between the fastener and the support bracket. However, prior to tightening the washer against the back panel 116, the detents 152 of the support bracket 112 and the detents of the washer (again, not shown) allow for the position of the support bracket relative to the fastener 24 (and the inner structure S) to be adjusted to suit the suit the construction of the inner structure S. For example, the support bracket 112 can be moved upward or downward with conjoint movement side-to-side relative to the inner structure S to position the support bracket in the desired horizontal and vertical position. This can accommodate misaligned support brackets 112 during erection of the facade support system 10 so that the support brackets 112 align with the slots 48 in the veneer support 14 and so that the support flange 46 of the veneer support is maintain in a substantially horizontal position when the veneer support is attached to the support brackets.

In one embodiment, the detents 152 of the serrated portion 150 are spaced apart by about 1/16 in (1.6 mm). This close phase separation of the detents 152 allows for fine-tuned adjustment of the position of the support bracket 112 relative to the inner structure S (e.g., fastener 24). Other degrees of spacing are also within the scope of the present disclosure.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A facade support system for supporting a veneer on a structure, the facade support system comprising:

a bracket configured to be attached to the structure, the bracket including:

a back panel having opposite front and rear faces;

a connecting member extending from the back panel in a generally forward direction, the connecting member defining a recess adjacent a front end of the connecting member and extending to a bottom of the connecting member, the recess having an outwardly oriented edge defining an upper boundary of the recess, the edge formed at an angle relative to a front of the connecting member enlarging a front end of the recess; and a support attachment member at least partially disposed within the recess, the support attachment member defining an upwardly oriented hook defining a support securing surface and a seat, the seat oriented opposite the edge; and a veneer support configured to be attached to the bracket by the support attachment member and positioned in the seat, the veneer support configured to be disposed in a mortar bed joint of the veneer.

2. The facade support system of claim 1, wherein at least a portion of the veneer support is disposed rearward of the front end of the connecting member when the veneer support is attached to the bracket by the support attachment member.

3. The facade support system of claim 1, wherein the connecting member includes an overhang portion defining at least a portion of the recess, the overhang portion overlying at least a portion of the support attachment member.

4. The facade support system of claim 1, wherein the connecting member includes a support bracing surface configured to brace the veneer support when the veneer support is attached to the bracket, the support bracing surface disposed rearward of the front end of the connecting member.

5. The facade support system of claim 4, wherein the support bracing surface defines at least a portion of the recess.

6. The facade support system of claim 5, wherein the support attachment member extends away from the support bracing surface.

7. The facade support system of claim 6, wherein the support bracing surface is generally planar.

8. The facade support system of claim 7, wherein the support bracing surface lies in a generally vertically extending plane.

9. The facade support system of claim 4, wherein the support securing surface is spaced apart from and opposing the support bracing surface, the support securing surface and the support bracing surface defining a receiving space therebetween to receive the veneer support when the veneer support is attached to the bracket.

10. The facade support system of claim 9, wherein the support securing surface and the support bracing surface are generally parallel to one another.

11. The facade support system of claim 9, wherein the support securing surface extends at an angle relative to the support bracing surface.

12. The facade support system of claim 1, wherein a front end of the upwardly oriented hook is generally even with the front end of the connecting member.

13. The facade support system of claim 1, wherein the connecting member is a first connecting member and the support attachment member is a first support attachment member, the bracket further including:

a second connecting member extending from the back panel in a generally forward direction, the second connecting member defining a recess adjacent a front end of the second connecting member and extending to a bottom of the connecting member, the recess having an outwardly oriented edge defining an upper boundary of the recess, the edge formed at an angle relative to a front of the connecting member enlarging a front end of the recess; and a second support attachment member at least partially disposed within the recess of the second connecting member, the second support attachment member defining an upwardly oriented hook defining a support securing surface and a seat, the seat oriented opposite the second connecting member edge, wherein the veneer support is configured to be attached to the bracket by the first and second support attachment members and positioned in the seats of the respective first and second support attachment members.

14. A facade support bracket for holding a veneer support having a mounting flange and a support flange, and being constructed to support a veneer on a structure, the facade support bracket comprising:

a back panel having opposite front and rear faces;

a connecting wall extending from the back panel in a generally forward direction, the connecting wall defining a recess adjacent a front end of the connecting wall; and a support attachment member at least partially disposed within the recess and configured to attach the veneer support to the facade support bracket within the recess of the connecting wall, the support attachment member defining an upwardly oriented hook defining a support securing surface and a seat, wherein the connecting wall defines an overhang extending outwardly beyond the support attachment member.

15. A facade support bracket as set forth in claim 14 wherein the recess is sized and shaped to receive an entirety of the mounting flange of the veneer support.

16. A facade support bracket as set forth in claim 14 wherein the connecting wall includes an edge defining an upper boundary of the recess that extends at an angle with respect to the front end of the connecting wall, and wherein the upwardly oriented hook is opposite the edge.

17. A facade support bracket as set forth in claim 14 wherein the connecting wall is a first connecting wall and the support attachment member is a first support attachment member, the bracket further including:

a second connecting wall extending from the back panel in a generally forward direction, the second connecting wall defining a recess adjacent a front end of the second connecting wall; and a second support attachment member at least partially disposed within the recess of the second connecting member, the second support attachment member defining an upwardly oriented hook defining a support securing surface and a seat, wherein the connecting wall defines an overhang extending outwardly beyond the support attachment member, and wherein the veneer support is configured to be attached to the bracket by the first and second support attachment members.

* * * * *